US009842537B2

(12) United States Patent
Lim et al.

(10) Patent No.: US 9,842,537 B2
(45) Date of Patent: Dec. 12, 2017

(54) PIXEL, DISPLAY DEVICE COMPRISING THE SAME AND HAVING AN INITIALIZATION PERIOD AND DRIVING METHOD THEREOF

(71) Applicant: SAMSUNG DISPLAY CO., LTD., Yongin-si, Gyeonggi-do (KR)

(72) Inventors: Jae Keun Lim, Suwon-si (KR); Jong Hee Kim, Yongin-si (KR); Chong Chul Chai, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 2 days.

(21) Appl. No.: 14/991,900

(22) Filed: Jan. 8, 2016

(65) Prior Publication Data

US 2016/0203794 A1 Jul. 14, 2016

(30) Foreign Application Priority Data

Jan. 13, 2015 (KR) ..... 10-2015-0006147

(51) Int. Cl.
*G09G 3/32* (2016.01)
*G09G 3/3225* (2016.01)

(52) U.S. Cl.
CPC ... *G09G 3/3225* (2013.01); *G09G 2300/0876* (2013.01); *G09G 2310/0216* (2013.01); *G09G 2310/08* (2013.01); *G09G 2320/045* (2013.01)

(58) Field of Classification Search
CPC ..... G09G 3/3225
USPC ..... 345/82
See application file for complete search history.

(56) References Cited

U.S. PATENT DOCUMENTS

2005/0206591 A1 9/2005 Wang et al.
2006/0071884 A1* 4/2006 Kim ..... G09G 3/3233 345/76
2012/0001896 A1* 1/2012 Han ..... G09G 3/3233 345/214
2014/0198085 A1* 7/2014 Park ..... G09G 3/3233 345/207
2014/0353616 A1* 12/2014 Park ..... G09G 3/3208 257/40

(Continued)

FOREIGN PATENT DOCUMENTS

KR 10-2013-0063171 A 6/2013
KR 10-2014-0053605 A 5/2014

*Primary Examiner* — Long D Pham
(74) *Attorney, Agent, or Firm* — Lewis Roca Rothgerber Christie LLP

(57) ABSTRACT

A display device includes: a display unit including a plurality of pixels, each of the pixels including: an OLED; and a driving transistor to supply current to an anode of the OLED according to a voltage applied to a gate of the driving transistor and a power supply voltage; a scan driver to supply scan signals to the pixels; an initialization driver to supply initializing signals to the pixels; a data driver to supply data signals to the pixels; light emission drivers to supply first and second light emission signals to the pixels; and a power supply to supply the power supply voltage and an initialization voltage to the pixels, wherein the initialization voltage is supplied to the anode during a first period, and the power supply voltage corresponding to a threshold voltage of the driving transistor is supplied to the gate during a first sub-period of the first period.

12 Claims, 9 Drawing Sheets

(56) References Cited

U.S. PATENT DOCUMENTS

2015/0145849 A1* 5/2015 Choi ..... G09G 3/3233
345/212

* cited by examiner

PIXEL, DISPLAY DEVICE COMPRISING THE SAME AND HAVING AN INITIALIZATION PERIOD AND DRIVING METHOD THEREOF

CROSS-REFERENCE TO RELATED APPLICATION

This application claims priority to and the benefit of Korean Patent Application No. 10-2015-0006147 filed in the Korean Intellectual Property Office on Jan. 13, 2015, the entire contents of which are incorporated herein by reference.

BACKGROUND

1. Field

The one or more aspects of the present invention relate to a pixel, a display device including the pixel and a method of driving the display device. More particularly, one or more aspects of the present invention relate to a pixel having an excellent display quality, a display device including the pixel and a method of driving the display device.

2. Description of the Related Art

An organic light emitting diode display uses organic light-emitting diodes (OLEDs) having a luminance controlled by a current or a voltage. The organic light emitting diode display is suitable for high contrast and rapid response, and thus, has been used for a mobile phone, a smartphone, a laptop computer, a terminal for digital broadcasting, a personal digital assistant (PDA), a portable multimedia player (PMP), a navigation device, a slate personal computer (PC), a tablet PC, an ultrabook, a wearable device, a digital television (TV), a desktop computer, a digital signage, and the like.

An active matrix OLED (AMOLED) includes a plurality of scan lines, a plurality of data lines, a plurality of power lines, and a plurality of pixel circuits connected to the lines and arranged in a matrix form. In general, each of the pixel circuits includes an OLED, two transistors, that is, a switching transistor for delivering a data signal and a driving transistor for driving the OLED according to the data signal, and one capacitor for maintaining a data voltage.

The organic light emitting diode display has relatively low power consumption, but a magnitude of a current flowing through the OLED may vary with a variation in a voltage between a gate and a source of the driving transistor that drives the OLED. For example, a threshold voltage variation of the driving transistors, may cause display unevenness.

In this regard, research into a compensating circuit including a plurality of transistors and capacitors to compensate for the threshold voltage has been conducted. For example, a compensating circuit may be formed in each pixel circuit. However, the compensating circuit generally utilizes a large number of transistors and capacitors that are mounted on each pixel.

The above information disclosed in this Background section is only for enhancement of understanding of the background of the invention and therefore it may contain information that does not form prior art.

SUMMARY

One or more example embodiments of the present invention provide a pixel having excellent display quality by increasing a contrast ratio, a display device including the pixel, and a method of driving the display device.

One or more example embodiments of the present invention provide a method of driving a display device capable of sufficiently maintaining a data input period or a light emission period and stably performing each operation step by sufficiently ensuring periods at which respective operation steps of the display device are performed.

An exemplary embodiment provides a display device including: a display unit including a plurality of pixels arranged therein, each of the pixels including: an organic light-emitting diode (OLED) configured to emit light in response to a current applied to an anode of the OLED; and a driving transistor configured to supply the current to the anode according to a voltage applied to a gate of the driving transistor and a power supply voltage; a scan driver configured to supply scan signals to the pixels; an initialization driver configured to supply initializing signals to the pixels; a data driver configured to supply data signals to the pixels; first and second light emission drivers configured to supply first light emission signals and second light emission signals, respectively, to the pixels; and a power supply configured to supply the power supply voltage and an initialization voltage to the pixels, wherein the anode of the OLED is configured to receive the initialization voltage during a first period, and the gate of the driving transistor is configured to receive the power supply voltage corresponding to a threshold voltage of the driving transistor during a first sub-period included in the first period.

The gate of the driving transistor may be configured to receive the initialization voltage during a period included in the first period except for the first sub-period.

Each of the pixels may further include: a first transistor including a gate connected to a corresponding one of first light emission lines through which a corresponding one of the first light emission signals is supplied, one end connected to a drain of the driving transistor and a second node, and another end connected to the anode; and a second transistor including a gate connected to a corresponding one of the second light emission lines through which a corresponding one of the second light emission signals is supplied, one end connected to the power supply voltage, and another end connected to a source of the driving transistor and a first node.

Each of the pixels may further include: a third transistor including a gate connected to a corresponding one of initialization lines, one end connected to the initialization voltage, and another end connected to the anode.

Each of the pixels may further include: a fourth transistor including a gate connected to the corresponding one of the initialization lines, one end connected to the gate of the driving transistor and a third node, and another end connected to the second node, the fourth transistor being configured to diode-connect the driving transistor according to a corresponding one of the initializing signals supplied through the corresponding one of the initialization lines.

Each of the pixels may further include: a storage capacitor including one end connected to the gate of the driving transistor and another end connected to the initialization voltage; a fifth transistor including a gate connected to a corresponding one of scan lines and one end connected to a corresponding one of data lines, the fifth transistor being configured to transmit a corresponding one of the data signals to the driving transistor according to a corresponding one of the scan signals supplied to the corresponding one of the scan lines; a boosting capacitor including one end connected to another end of the fifth transistor and another end connected to the gate of the driving transistor; and a sixth transistor including a gate connected to the corresponding one of the initialization lines, one end connected to the other end of the boosting capacitor, and another end connected to the source of the driving transistor.

The initialization driver and the second light emission driver may be configured to supply an initializing signal from among the initializing signals and a second light emission signal from among the second light emission signals, respectively, at an enable level during the first period.

The first light emission driver may be configured to supply a first light emission signal from among the first light emission signals at an enable level during a sub-period included in the first period except for the first sub-period.

The data driver may be further configured to output a switching signal, and the display device may further include a multiplexer connected to the data driver, the multiplexer being configured to select ones of the data signals output from the data driver according to the switching signal when the scan signals at enable levels are supplied, and to output the selected ones of the data signals to respective ones of a plurality of data lines.

Another exemplary embodiment provides a method of driving a display device, the display device including: a display unit including a plurality of pixels arranged therein, each of the pixels including: an OLED configured to emit light in response to a current applied to an anode of the OLED; and a driving transistor configured to supply the current to the anode of the OLED according to a voltage applied to a gate of the driving transistor and a power supply voltage; a scan driver configured to supply scan signals to the pixels; an initialization driver configured to supply initializing signals to the pixels; a data driver configured to supply data signals to the pixels; a first light emission driver connected to the pixels through a plurality of first light emission lines and configured to supply first light emission signals; a second light emission driver connected to the pixels through a plurality of second light emission lines and configured to supply second light emission signals; and a power supply unit configured to supply the power supply voltage and an initialization voltage to the pixels, the method including: supplying the initialization voltage to the anode of the OLED by supplying the first light emission signals, the second light emission signals, and the initializing signals at enable levels to the pixels during an initialization period; supplying the power supply voltage corresponding to a threshold voltage of the driving transistor to the gate of the driving transistor by changing the levels of the first light emission signals to disable levels during a compensation period; applying the data signals to the pixels by changing the levels of the second light emission signals and the initializing signals to disable levels, and supplying the scan signals at enable levels to the pixels during a data input period; and changing the levels of the first light emission signals and the second light emission signals to enable levels to emit light from the OLED during a light emission period.

Each of the pixels may further include: a first transistor including a gate connected to a corresponding one of the first light emission lines, one end connected to a drain of the driving transistor and a second node, and another end connected to the anode of the OLED; a second transistor including a gate connected to a corresponding one of the second light emission lines, one end connected to the power supply voltage, and another end connected to a source of the driving transistor and a first node; a third transistor including a gate connected to a corresponding one of initialization lines, one end connected to the initialization voltage, and another end connected to the anode of the OLED; and a fourth transistor including a gate connected to the corresponding one of the initialization lines, one end connected to the gate of the driving transistor and a third node, and another end connected to the second node, the fourth transistor being configured to diode-connect the driving transistor according to a corresponding one of the initializing signals supplied through the corresponding one of the initialization lines, and wherein the supplying of the initialization voltage may include: supplying the initialization voltage to the anode of the OLED by turning on the third transistor; and supplying the initialization voltage to the gate of the driving transistor by turning on the first transistor, the second transistor, and the fourth transistor.

The supplying of the power supply voltage may include diode-connecting the driving transistor when turning off the second transistor.

Yet another exemplary embodiment provides a pixel including: an OLED configured to emit light in response to a current applied to an anode of the OLED; a driving transistor configured to supply the current to the anode of the OLED according to a voltage applied to a gate of the driving transistor and a power supply voltage; a first transistor including a gate connected to a corresponding one of first light emission lines, one end connected to a drain of the driving transistor and a second node, and another end connected to the anode of the OLED; a second transistor including a gate connected to a corresponding one of the second light emission lines, one end connected to the power supply voltage, and another end connected to a source of the driving transistor and a first node; a third transistor including a gate connected to a corresponding one of initialization lines, one end connected to am initialization voltage, and another end connected to the anode of the OLED; a fourth transistor including a gate connected to the corresponding one of the initialization lines, one end connected to the gate of the driving transistor and a third node, and another end connected to the second node, the fourth transistor being configured to diode-connect the driving transistor according to a corresponding one of initializing signals supplied through the corresponding one of the initialization lines; a storage capacitor including one end connected to the gate of the driving transistor and another end connected to the initialization voltage; a fifth transistor including a gate connected to a corresponding one of scan lines and one end connected to a corresponding one of data lines, the fifth transistor being configured to transmit a corresponding one of data signals to the driving transistor according to a corresponding one of scan signals supplied to the corresponding one of the scan lines; a boosting capacitor including one end connected to another end of the fifth transistor and another end connected to the gate of the driving transistor; and a sixth transistor including a gate connected to the corresponding one of the initialization lines, one end connected to the one end of the boosting capacitor, and another end connected to the source of the driving transistor.

Aspects and effects of a pixel, a display device including the pixel and a method of driving the display device are described below.

According to at least one of the exemplary embodiments, a contrast ratio of a display image may be increased.

Further, according to the driving method, a stable operation may be performed since periods of respective operation steps may be sufficiently ensured in an image implementation.

Additional aspects and embodiments of the present invention may become apparent from the detailed description below. However, various changes and modifications within the spirit and scope of the present invention as understood by a person of an ordinary skill in the art should also be included, and thus, it should be understood that the detailed description of the exemplary embodiments are merely given as examples.

BRIEF DESCRIPTION OF THE DRAWINGS

The above and other aspects and features of the present invention will become apparent to those skilled in the art from the following detailed description of the exemplary embodiments with reference to the accompanying drawings.

DETAILED DESCRIPTION

Figure 1:
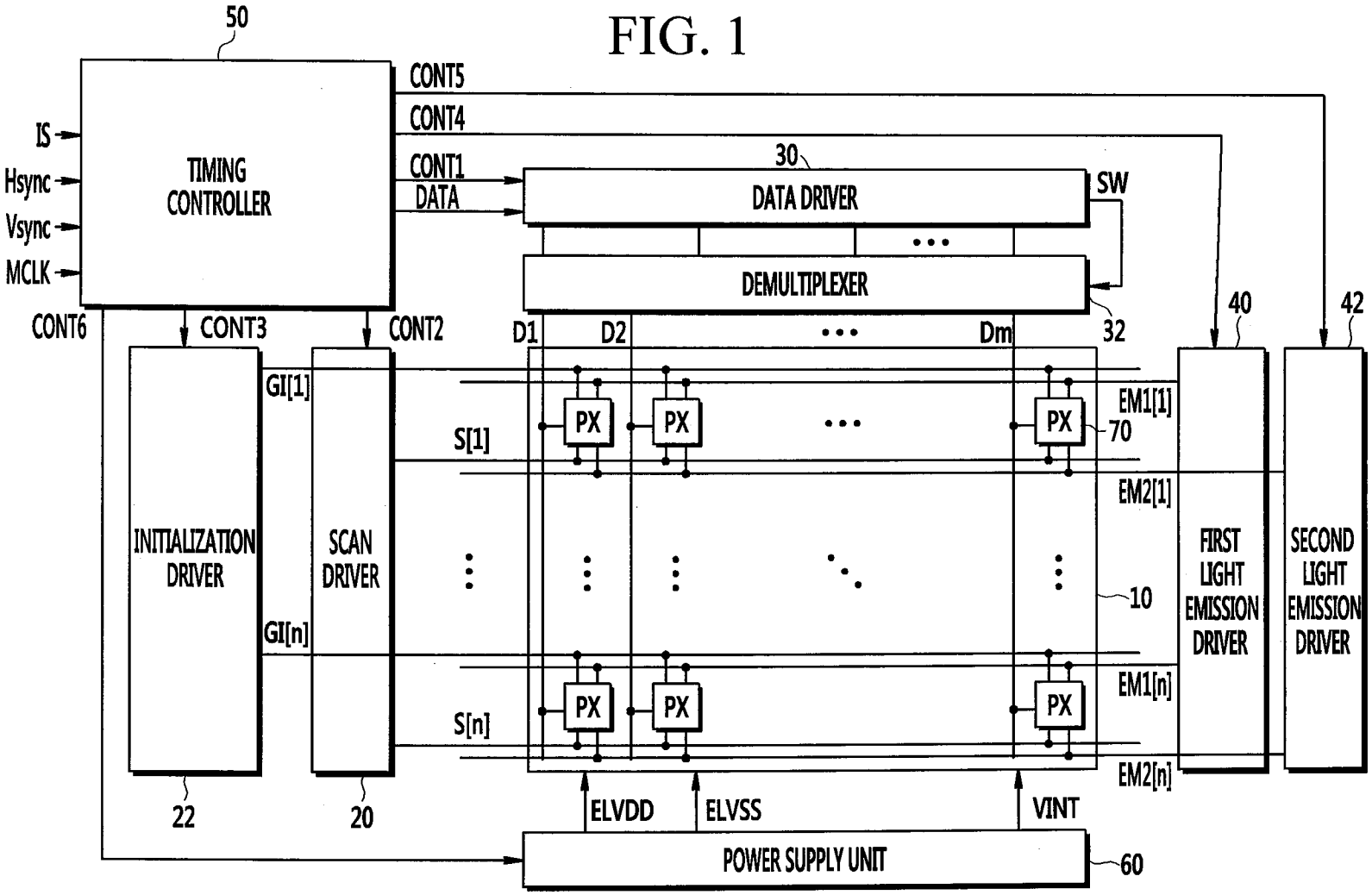
FIG. 1 is a block diagram illustrating a display device according to an exemplary embodiment.

Hereinafter, exemplary embodiments disclosed in this specification will be described in detail with reference to the accompanying drawings. The same or a similar reference numerals will be used to refer to the same or a similar component, and repeated description thereof will be omitted. It is to be noted that the suffixes of components used in the following description, such as "module" and "unit", are simply used considering the ease of writing this specification or used interchangeably, and do not have any particular importance or role. Further, if it is determined that detailed description of an associated prior art may obscure a subject matter of an exemplary embodiment disclosed in this specification when the exemplary embodiment disclosed in this specification is described, the detailed description may be omitted. In addition, the accompanying drawings merely help to understand the exemplary embodiments disclosed in this specification, and do not restrict the spirit or scope disclosed in this specification. Further, it should be understood that the present invention covers all modifications, equivalents or substitutes that come within the spirit and the scope.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," or "accessing" another element or layer, it can be directly on, connected to, coupled to, or accessing the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

A pixel, a display device, and a method of driving the display device according to exemplary embodiments may be applied to various types of electronic devices such as a digital television (TV), a desktop computer, a digital signage, a mobile phone, a smartphone, a laptop computer, a terminal for digital broadcasting, a personal digital assistant (PDA), a portable multimedia player (PMP), a navigation device, a slate personal computer (PC), a tablet PC, an ultrabook, a wearable device, for example, a smart watch, a smart glass, a head mounted display (HMD), and/or the like.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an exemplary embodiment.

Referring to FIG. 1, the display device includes a display unit (e.g., a display area) 10, a scan driver 20, an initialization driver 22, a data driver 30, a demultiplexer 32, light emission drivers 40 and 42, a timing controller 50, and a power supply unit (or a power supply) 60. The components illustrated in FIG. 1 are only an example of implementing the display device, and thus, the display device described in this specification according to some embodiments of the present invention may include more or less components than the above-listed components.

The display unit 10 is a display panel including a plurality of pixels PX. Each of the pixels PX is connected to a corresponding one of a plurality of scan lines S[1] to S[n], a corresponding one of a plurality of initialization lines GI[1] to GI[n], a corresponding one of a plurality of first light emission lines EM1[1] to EM1[*n*], a corresponding one of a plurality of second light emission lines EM2[1] to EM2[*n*], and a corresponding one of a plurality of data lines D[1] to D[m]. Each of the plurality of pixels PX displays an image (e.g., emits light) in response to receiving a corresponding image data signal.

The plurality of pixels PX included in the display unit 10 are respectively connected to the plurality of scan lines S[1] to S[n], the plurality of initialization lines GI[1] to GI[n], the plurality of first light emission lines EM1[1] to EM1[*n*], the plurality of second light emission lines EM2[1] to EM2[*n*], and the plurality of data lines D[1] to D[m], and are substantially arranged in the matrix form. In this case, a first light emission line EM1[*j*] connected to pixels positioned on a jth row may correspond to a second light emission line EM2[*j*−1] connected to pixels positioned on a (j−1)th row.

The plurality of scan lines S[1] to S[n] extend substantially in a row direction and are substantially parallel to one another. The plurality of initialization lines GI[1] to GI[n] extend substantially in the row direction and are substantially parallel to one another. The plurality of first light emission lines EM1[1] to EM1[*n*] extend substantially in the row direction and are substantially parallel to one another. The plurality of second light emission lines EM2[1] to EM2[*n*] extend substantially in the row direction and are substantially parallel to one another. The plurality of data lines D[1] to D[m] extend substantially in a column direction and are substantially parallel to one another.

Each of the plurality of pixels PX of the display unit 10 is supplied with a power supply voltage, for example, a first power supply voltage ELVDD and a second power supply voltage ELVSS from the power supply unit 60. Further, each of the plurality of pixels PX is supplied with an initialization voltage VINT from the power supply unit 60.

Each of the plurality of pixels PX receives a first light emission signal from corresponding ones of the first light emission lines EM1[1] to EM1[*n*] and a second light emission signal from corresponding ones of the second light emission lines EM2[1] to EM2[*n*].

Further, each of the plurality of pixels PX receives an initializing signal from corresponding ones of the plurality of initialization lines GI[1] to GI[n].

The scan driver 20 is connected to the display unit 10 through the plurality of scan lines S[1] to S[n]. The scan driver 20 generates a plurality of scan signals according to a scan control signal CONT2, and transmits each of the generated scan signals to a corresponding one of the plurality of scan lines S[1] to S[n].

The scan control signal CONT2 is a signal generated and transmitted by the timing controller 50 to control an operation of the span driver 20. The scan control signal CONT2 may include a scan start signal, a clock signal, and the like. The scan start signal is a signal that generates a first scan signal for displaying an image of one frame. The clock signal is a synchronizing signal for sequentially applying scan signals to the plurality of scan lines S[1] to S[n].

The initialization driver 22 generates a plurality of initializing signals according to an initialization control signal CONT3. The initialization driver 22 transmits the plurality of initializing signals to the plurality of initialization lines GI[1] to GI[n], respectively, according to the initialization control signal CONT3.

The data driver 30 transmits a data signal to the display unit 10 through the multiplexer 32. The data driver 30 may control an operation of the multiplexer 32 using a switching signal SW. The data driver 30 may receive an image data signal DATA, and may transmit the data signal and the switching signal SW to the multiplexer 32 according to a data control signal CONT1.

The data control signal CONT1 is a signal generated and transmitted by the timing controller 50 to control an operation of the data driver 30.

The data driver 30 selects a grayscale voltage according to the image data signal DATA, and transmits the selected grayscale voltage as a data signal to the multiplexer 32. The data driver 30 samples and holds the received image data signal DATA according to the data control signal CONT1, and transmits the switching signal SW and a plurality of data signals respectively corresponding to the plurality of data lines D[1] to D[m] to the multiplexer 32.

The multiplexer 32 is connected to the respective pixels PX of the display unit 10 through the plurality of data lines D[1] to D[m]. The multiplexer 32 delivers each of the data signals to a corresponding one of the plurality of data lines D[1] to D[m] according to the switching signal SW.

For example, the data driver 30 and the multiplexer 32 may apply data signals having voltages that fall within a range (e.g., predetermined range) to the plurality of data lines D[1] to D[m] in response to the scan signals having gate-on voltages.

The light emission drivers 40 and 42 generate the plurality of first light emission signals and the plurality of second light emission signals according to light emission control signals CONT4 and CONT5, respectively. The light emission drivers 40 and 42 may include a first light emission driver 40 and a second light emission driver 42.

The first light emission driver 40 transmits the plurality of first light emission signals to the plurality of the first light emission lines EM1[1] to EM1[*n*], respectively, according to a first light emission control signal CONT4. The second light emission driver 42 transmits the plurality of second light emission signals to the plurality of the second light emission lines EM2[1] to EM2[n], respectively, according to a second light emission control signal CONT5.

The timing controller 50 receives an image signal IS input from the outside (e.g., outside of or external to the timing controller 50) and an input control signal that controls display of the image signal IS. The image signal IS may include luminance information distinguished by a gray level of each of the pixels PX, and may include frame data described above.

Some examples of the input control signal transmitted to the timing controller 50 may include a vertical synchronizing signal Vsync, a horizontal synchronizing signal Hsync, a main clock signal MCLK, and the like.

The timing controller 50 generates the data control signal CONT1, the scan control signal CONT2, the initialization control signal CONT3, the first and second light emission control signals CONT4 and CONT5, the image data signal DATA and a power control signal CONT6 according to the image signal IS, the horizontal synchronizing signal Hsync, the vertical synchronizing signal Vsync, and the main clock signal MCLK.

The timing controller performs appropriate image processing of the image signal IS in accordance with operation conditions of the display unit 10 and the data driver 30 based on the input image signal IS and the input control signal. For example, the timing controller 50 may generate the image data signal DATA through image processing operations, such as gamma correction and luminance compensation, performed on the image signal IS.

For example, the timing controller 50 generates the data control signal CONT1 that controls the operation of the data driver 30, and transmits the generated data control signal CONT1 to the data driver 30 together with the image data signal DATA generated through the image processing operations. Further, the timing controller 50 transmits the scan control signal CONT2 to the scan driver 20 that controls the operation of the scan driver 20.

Further, the timing controller 50 may control an operation of the power supply unit 60. The power supply unit 60 may provide the power supply voltages ELVDD and ELVSS for operations of the pixels PX of the display unit 10.

For example, the timing controller 50 may transmit the power control signal CONT6 to the power supply unit 60 to drive the power supply unit 60.

Further, the timing controller 50 may transmit the first and second light emission control signals CONT4 and CONT5 to the first and second light emission drivers 40 and 42, respectively, to drive the first and second light emission drivers 40, and 42.

The power supply unit 60 is connected to a plurality of power lines to provide the plurality of power lines with the first power supply voltage ELVDD, the second power supply voltage ELVSS, and the initialization voltage VINT. The power supply unit 60 may adjust voltage levels of the first power supply voltage ELVDD, the second power supply voltage ELVSS, and the initialization voltage VINT according to the power control signal CONT6. Driving voltages to operate the pixels PX may be provided by the first power supply voltage ELVDD and the second power supply voltage ELVSS.

Figure 2:
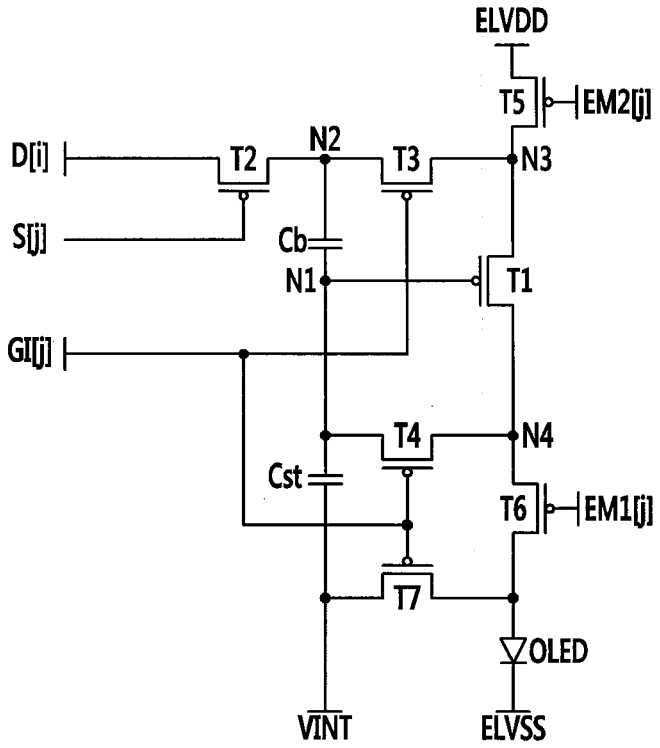
FIG. 2 is a circuit diagram illustrating a pixel of the display device according to an exemplary embodiment.

Next, referring to FIG. 2, a detailed description of a pixel PX according to an exemplary embodiment will be provided.

FIG. 2 is a circuit diagram illustrating a pixel of the display device according to an exemplary embodiment. As illustrated, the pixel may include first to seventh transistors T1 to T7, a boosting capacitor Cb, a storage capacitor Cst, and an organic light-emitting diode (OLED) that emits light in response to a current flowing from the first power supply voltage ELVDD.

The first transistor T1 includes a gate connected to a first node N1, one end connected to a third node N3, and another end connected to a fourth node N4. The first transistor T1 is turned on in response to a voltage applied to the gate thereof to control a driving current supplied to the OLED.

The second transistor T2 includes one end connected to a data line D[i] through which a corresponding one of the data signals is supplied from the data driver 30, a gate connected to a scan line S[j] through which a corresponding one of the scan signals is supplied from the scan driver 20, and another end connected to a second node N2. The second transistor T2 is turned on in response to the scan signal supplied through the scan line S[j] to transmit the data signal to the second node N2.

The third transistor T3 includes one end connected to the second node N2, another end connected to the third node N3, and a gate connected to an initialization line G[j]. The third transistor T3 is turned on in response to an initializing signal transmitted through the initialization line GI[j] to connect the second node N2 to the third node N3.

The boosting capacitor Cb includes one end connected to the first node N1 and another end connected to the second node N2.

The fourth transistor T4 includes one end connected to the first node N1, another end connected to the fourth node N4, and a gate connected to the initialization line GI[j]. The fourth transistor T4 is turned on in response to the initializing signal to connect the first node N1 to the fourth node N4. The fourth transistor T4 is turned on in response to the initializing signal received through the initialization line GI[j] to connect the gate of the first transistor T1 and the other end of the first transistor T1 to each other, such that the first transistor T1 is diode-connected.

The fifth transistor T5 includes one end connected to the first power supply voltage ELVDD, another end connected to the third node N3, and a gate connected to a second light emission line EM2[j] through which a second light emission signal is supplied from the second light emission driver 42. The fifth transistor T5 is turned on in response to the second light emission signal supplied through the second light emission line EM2[j] to transmit the first power supply voltage ELVDD to the third node N3.

The sixth transistor T6 includes one end connected to the fourth node N4, another end connected to an anode of the OLED, and a gate connected to a first light emission line EM1[j] through which a first light emission signal is supplied from the first light emission driver 40. The sixth transistor T6 is turned on in response to the first light emission signal supplied from the first light emission line EM1[j] to transmit a current flowing from the first transistor T1 to the OLED.

The seventh transistor T7 includes one end connected to the anode of the OLED, another end connected to the initialization voltage VINT, and a gate connected to the initialization line GI[j]. The seventh transistor T7 is turned on in response to the initializing signal supplied from the initialization line GI[j] to transmit the initialization voltage VINT to the anode of the OLED.

The storage capacitor Cst includes one end connected to the first node N1 and another end connected to the initialization voltage VINT.

The OLED includes the anode connected to the other end of the sixth transistor T6 and a cathode connected to the second power supply voltage ELVSS. The OLED may emit light corresponding to one of primary colors. Examples of the primary colors may include three primary colors of red, green and blue, and a desired color may be displayed by combining the three primary colors with respect to space or time.

Each of the first to seventh transistors T1 to T7 may be a P-channel metal oxide semiconductor (PMOS) transistor. In this case, a gate-on voltage that turns on each of the first to seventh transistors T1 to T7 is a low-level voltage, and a gate-off voltage that turns off each of the first to seventh transistors T1 to T7 is a high-level voltage.

Although the PMOS transistor is used in the example embodiment of FIG. 2, the present invention is not limited thereto, and at least one of the first to seventh transistors T1 to T7 may be an N-channel metal oxide semiconductor (NMOS) transistor. In this case, a gate-on voltage that turns on the NMOS transistor is a high-level voltage, and a gate-off voltage that turns off the NMOS transistor is a low-level voltage. For convenience of description, the transistors will be described in the context of PMOS transistors.

Each of the first to seventh transistors T1 to T7 may be provided as one of an amorphous silicon thin film transistor (amorphous-Si TFT), a low temperature poly-silicon (LTPS) TFT, and an oxide TFT. The oxide TFT may include an oxide, such as amorphous indium gallium zinc oxide (IGZO), zinc oxide (ZnO), and/or titanium oxide (TiO), as an active layer.

Next, a method of driving the display device according to an exemplary embodiment will be described with reference to FIGS. 3 to 9.

Figure 3:
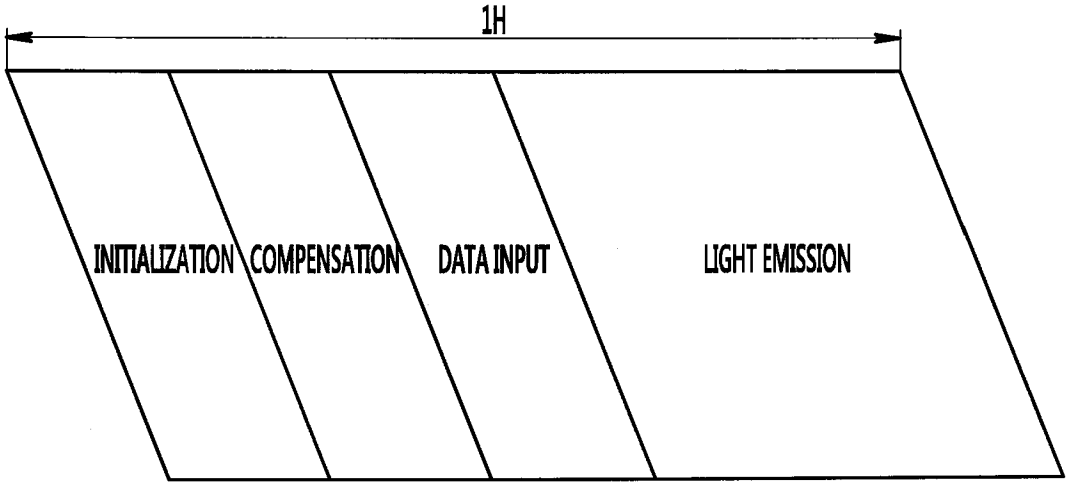
FIG. 3 is a diagram illustrating one frame of the display device according to an exemplary embodiment.

FIG. 3 illustrates one frame of the display device according to an exemplary embodiment. As illustrated in FIG. 3, one frame 1H includes an initialization period, a compensation period, a data input period, and a light emission period. During each period, an appropriate operation for each period may be sequentially performed on a first pixel row to an nth pixel row. For example, scan signal lines may be sequentially driven during the data input period.

Figure 4:
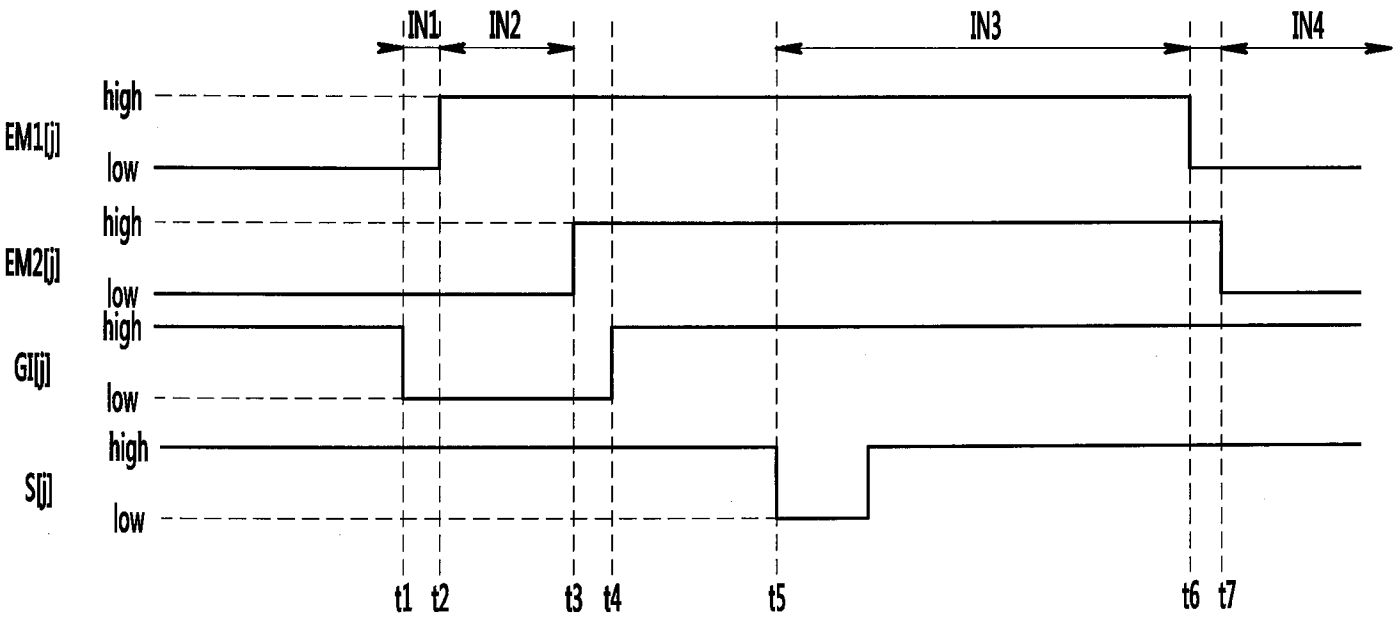
FIG. 4 is a timing chart illustrating a method of driving the display device according to an exemplary embodiment.

FIG. 4 is a timing chart illustrating a method of driving the display device according to an exemplary embodiment, and FIGS. 5 to 9 are circuit diagrams illustrating pixel circuits associated with the method of driving the display device according to an exemplary embodiment.

Referring to FIG. 4, at a first time t1, each of the first light emission signal and the second light emission signal supplied to the first light emission line EM1[*j*] and the second light emission line EM2[*j*] maintains a low-level voltage, and a level of the initialization signal supplied to the initialization line GI[j] is changed from a high-level voltage to a low-level voltage.

Figure 5:
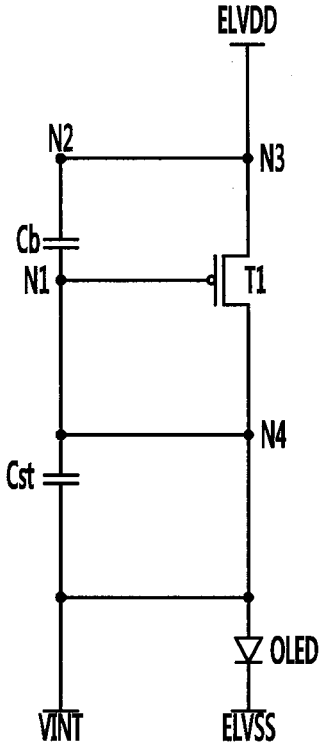
FIGS. 5 to 9 are circuit diagrams illustrating pixel circuits associated with the method of driving the display device according to an exemplary embodiment.

Thus, as illustrated in FIG. 5 and referring to FIG. 2, each of the fifth transistor T5 and the sixth transistor T6 may be in an on state, and each of the third transistor T3, the fourth transistor T4, and seventh transistor T7 may be turned on.

Then, during an initialization period IN1, the initialization voltage VINT is transmitted to the anode of the OLED, the fourth node N4, and the first node N1. A voltage of the gate of the first transistor T1 according to driving of a previous frame is initialized to the initialization voltage VINT. Further, an anode voltage of the OLED may be set to the initialization voltage VINT. In this case, the first power supply voltage ELVDD is supplied to the second node N2.

Figure 6:
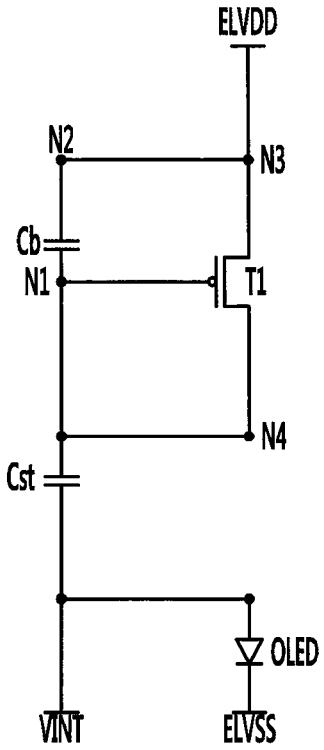

Next, at a second time t2, a level of the first light emission signal supplied to the first light emission line EM1[*j*] is changed to a high-level voltage. Thus, as illustrated in FIG. 6, the sixth transistor T6 is turned off.

During a compensation period IN2, the initialization voltage VINT is transmitted only to the other end of the storage capacitor Cst and the anode of the OLED. The first transistor T1 is diode-connected, and a compensation voltage ELVDD-Vth (Vth is a positive value) obtained by subtracting a threshold voltage Vth of the first transistor T1 from the first power supply voltage ELVDD is applied to a gate electrode of the first transistor T1.

Then, the driving voltage ELVDD and the compensation voltage ELVDD-Vth are applied to respective ends of the boosting capacitor Cb, and charge corresponding to a voltage difference between the respective ends is stored in the boosting capacitor.

Further, the compensation voltage ELVDD-Vth and the initialization voltage Vint are applied to respective ends of the storage capacitor Cst, and charge corresponding to a voltage difference between the respective ends is stored in the storage capacitor Cst.

At a third time t3, a level of the second light emission signal supplied to the second light emission line EM2[*j*] is changed to a high-level voltage. Then, the fifth transistor T5 is turned off, and the first node N1 and the second node N2 become floating nodes.

Figure 7:
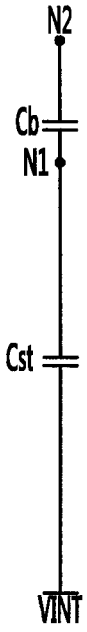

At a fourth time t4, the level of the initialization signal supplied to the initialization line GI[j] is changed from the low-level voltage to a high-level voltage. Thus, as illustrated in FIG. 7, the third transistor T3, the fourth transistor T4, and the seventh transistor T7 are turned off. The third time t3 and the fourth time t4 may be the same time (e.g., may occur concurrently or simultaneously).

In this case, in response to the initialization signal supplied to the initialization line GI[j] being changed to the high-level voltage, a voltage of the first node N1 is raised by being coupled with the initialization signal having the high-level voltage, and a voltage of the second node N2 is raised by the boosting capacitor Cb.

Figure 8:
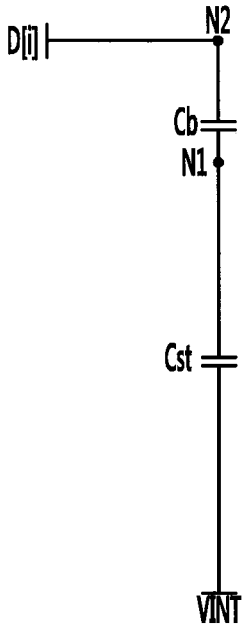

Then, at a fifth time t5, a level of the scan signal supplied to the scan line S[j] is changed to a low-level voltage. Thus, as illustrated in FIG. 8, the second transistor T2 is turned on, and the data signal supplied to the data line D[i] is applied to the second node N2.

Then, when the boosting capacitor Cb and the storage capacitor Cst are connected in series, the first node N1 may have a voltage shown in the following Equation 1.

$$\frac{Cb \times \mathrm{V}data + Cst \times ELVDD}{Cb + Cst} - \mathrm{V}th \qquad \text{Equation 1}$$

Here, Vdata denotes a voltage value of the data signal supplied to the data line D[i], Cb denotes a capacitance of the boosting capacitor Cb, and Cst denotes a capacitance of the storage capacitor Cst.

At a sixth time t6, a level of the first light emission signal supplied to the first light emission line EM1[*j*] is changed to a low-level voltage. At a seventh time t7, a level of the second light emission signal supplied to the second light emission line EM2[*j*] is changed to a low-level voltage. The sixth time t6 and the seventh time t7 may be the same time (e.g., may occur concurrently or simultaneously).

Figure 9:
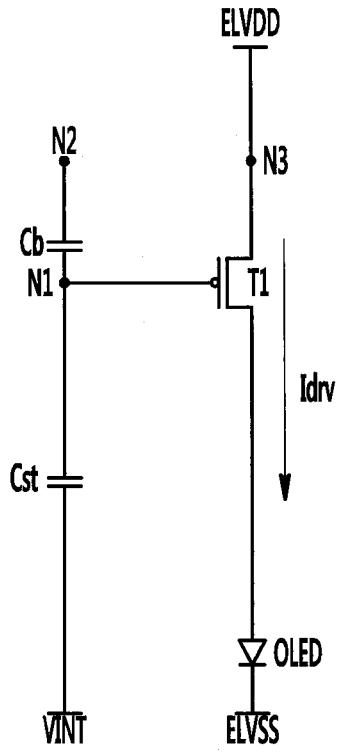

Then, as illustrated in FIG. 9, the fifth transistor T5 and the sixth transistor T6 are turned on, and a driving current Idrv may flow to the OLED through the first transistor T1 due to the voltages stored in the boosting capacitor Cb and the storage capacitor Cst.

The pixel, the display device including the pixel, and the method of driving the display device according to the exemplary embodiments are effective in supplying the data signals to the pixels PX using the demultiplexer 32, since the compensation period IN2 may be separated from the period in which the data signals are written to the pixels PX.

Further, the pixel, the display device including the pixel, and the method of driving the display device according to the exemplary embodiments have an advantage in holding a voltage by arranging the boosting capacitor Cb and storage capacitor Cst in parallel with the first transistor T1.

In addition, according to the pixel, the display device including the pixel, and the method of driving the display device in the exemplary embodiments, it is possible to easily express a gray level of black by supplying the initialization voltage VINT to the anode of the OLED and the gate of the first transistor T1, and increase a contrast ratio.

At least some of the respective components may cooperatively operate to implement operations and controls of the pixel and the display device including the pixel, or the method of driving the display device according to various exemplary embodiments described above.

The above-described present invention may be embodied as computer-readable code on a medium having a program recorded thereon. The computer-readable medium may be any type of recording device in which data is stored in a computer system-readable manner. Examples of the computer-readable medium include a hard disk drive (HDD), a solid state disk (SSD), a silicon disk drive (SDD), a read only memory (ROM), a random access memory (RAM), a CD-ROM, a magnetic tape, a floppy disc, an optical data storage device, and the like, and the present invention may be embodied in a form of a carrier wave (for example, transmission over the Internet). Thus, the above detailed description should be considered illustratively rather than restrictively in all aspects. The spirit and scope of the present invention should be determined by a reasonable interpretation of the accompanying claims, and their equivalents, with all modifications falling within an equivalent range of the present invention being included in the spirit and scope of the present invention.

What is claimed is:

1. A display device comprising:

a display unit comprising a plurality of pixels arranged therein, each of the pixels comprising:

an organic light-emitting diode (OLED) configured to emit light in response to a current applied to an anode of the OLED; and a driving transistor configured to supply the current to the anode according to a voltage applied to a gate of the driving transistor and a power supply voltage;

a scan driver configured to supply scan signals to the pixels;

an initialization driver configured to supply initializing signals to the pixels;

a data driver configured to supply data signals to the pixels;

first and second light emission drivers configured to supply first light emission signals and second light emission signals, respectively, to the pixels;

a power supply configured to supply the power supply voltage and an initialization voltage to the pixels; and a timing controller configured to control the scan driver, the initialization driver, the data driver, the first and second light emission drivers, and the power supply, wherein the timing controller is configured to specifically control:

the first and second light emission drivers and the initialization driver to supply the first light emission signals, the second light emission signals, and the initializing signals at enable levels to the pixels during an initialization period, so that the initialization voltage is supplied to the anode of the OLED, the first emission drivers to change the levels of the first light emission signals to disable levels during a compensation period, so that the power supply voltage corresponding to a threshold voltage of the driving transistor is supplied to the gate of the driving transistor, the second light emission drivers and the initialization driver to change the second light emission signals and the initializing signals to disable levels, and the scan driver to supply the scan signals at enable levels to the pixels during a data input period, so that the data signals are applied to the pixels, and the first and second light emission drivers to change the levels of the first light emission signals and the second light emission signals to enable levels to emit light from the OLED during a light emission period.

2. The display device of claim 1, wherein:

the gate of the driving transistor is configured to receive the initialization voltage during a period included in a first period except for a first sub-period.

3. The display device of claim 2, wherein each of the pixels further comprises:

a first transistor including a gate connected to a corresponding one of first light emission lines through which a corresponding one of the first light emission signals is supplied, one end connected to a drain of the driving transistor and a second node, and another end connected to the anode; and a second transistor including a gate connected to a corresponding one of second light emission lines through which a corresponding one of the second light emission signals is supplied, one end connected to the power supply voltage, and another end connected to a source of the driving transistor and a first node.

4. The display device of claim 3, wherein each of the pixels further comprises:

a third transistor including a gate connected to a corresponding one of initialization lines, one end connected to the initialization voltage, and another end connected to the anode.

5. The display device of claim 4, wherein each of the pixels further comprises:

a fourth transistor including a gate connected to the corresponding one of the initialization lines, one end connected to the gate of the driving transistor and a third node, and another end connected to the second node, the fourth transistor being configured to diode-connect the driving transistor according to a corresponding one of the initializing signals supplied through the corresponding one of the initialization lines.

6. The display device of claim 5, wherein each of the pixels further comprises:

a storage capacitor including one end connected to the gate of the driving transistor and another end connected to the initialization voltage;

a fifth transistor including a gate connected to a corresponding one of scan lines and one end connected to a corresponding one of data lines, the fifth transistor being configured to transmit a corresponding one of the data signals to the driving transistor according to a corresponding one of the scan signals supplied to the corresponding one of the scan lines;

a boosting capacitor including one end connected to another end of the fifth transistor and another end connected to the gate of the driving transistor; and a sixth transistor including a gate connected to the corresponding one of the initialization lines, one end connected to the other end of the boosting capacitor, and another end connected to the source of the driving transistor.

7. The display device of claim 6, wherein:

the initialization driver and the second light emission driver are configured to supply an initializing signal from among the initializing signals and a second light emission signal from among the second light emission signals, respectively, at an enable level during the first period.

8. The display device of claim 7, wherein:

the first light emission driver is configured to supply a first light emission signal from among the first light emission signals at an enable level during a sub-period included in the first period except for the first sub-period.

9. The display device of claim 1, wherein:

the data driver is further configured to output a switching signal, and the display device further comprises a demultiplexer connected to the data driver, the demultiplexer being configured to select ones of the data signals output from the data driver according to the switching signal when the scan signals at enable levels are supplied, and to output the selected ones of the data signals to respective ones of a plurality of data lines.

10. A method of driving a display device, the display device comprising:

a display unit comprising a plurality of pixels arranged therein, each of the pixels comprising:

an OLED configured to emit light in response to a current applied to an anode of the OLED; and a driving transistor configured to supply the current to the anode of the OLED according to a voltage applied to a gate of the driving transistor and a power supply voltage;

a scan driver configured to supply scan signals to the pixels;

an initialization driver configured to supply initializing signals to the pixels;

a data driver configured to supply data signals to the pixels;

a first light emission driver connected to the pixels through a plurality of first light emission lines and configured to supply first light emission signals;

a second light emission driver connected to the pixels through a plurality of second light emission lines and configured to supply second light emission signals; and a power supply configured to supply the power supply voltage and an initialization voltage to the pixels, the method comprising:

supplying the initialization voltage to the anode of the OLED by supplying the first light emission signals, the second light emission signals, and the initializing signals at enable levels to the pixels during an initialization period;

supplying the power supply voltage corresponding to a threshold voltage of the driving transistor to the gate of the driving transistor by changing the levels of the first light emission signals to disable levels during a compensation period;

applying the data signals to the pixels by changing the levels of the second light emission signals and the initializing signals to disable levels, and supplying the scan signals at enable levels to the pixels during a data input period; and changing the levels of the first light emission signals and the second light emission signals to enable levels to emit light from the OLED during a light emission period.

11. The method of claim 10, wherein each of the pixels further comprises:

a first transistor including a gate connected to a corresponding one of the first light emission lines, one end connected to a drain of the driving transistor and a second node, and another end connected to the anode of the OLED;

a second transistor including a gate connected to a corresponding one of the second light emission lines, one end connected to the power supply voltage, and another end connected to a source of the driving transistor and a first node;

a third transistor including a gate connected to a corresponding one of initialization lines, one end connected to the initialization voltage, and another end connected to the anode of the OLED; and a fourth transistor including a gate connected to the corresponding one of the initialization lines, one end connected to the gate of the driving transistor and a third node, and another end connected to the second node, the fourth transistor being configured to diode-connect the driving transistor according to a corresponding one of the initializing signals supplied through the corresponding one of the initialization lines, and wherein the supplying of the initialization voltage comprises:

supplying the initialization voltage to the anode of the OLED by turning on the third transistor; and supplying the initialization voltage to the gate of the driving transistor by turning on the first transistor, the second transistor, and the fourth transistor.

12. The method of claim 11, wherein the supplying of the power supply voltage comprises diode-connecting the driving transistor when turning off the second transistor.

* * * * *